United States Patent [19]

Aboelfotoh

[11] 4,297,613

[45] Oct. 27, 1981

[54] D.C. SCAN PANEL

[75] Inventor: Mohamed O. Aboelfotoh, Poughkeepsie, N.Y.

[73] Assignee: International Business Machines Corporation, Armonk, N.Y.

[21] Appl. No.: 37,082

[22] Filed: May 8, 1979

[51] Int. Cl.[3] ..... H01J 17/34; H01J 61/067

[52] U.S. Cl. ..... 315/58; 313/217; 313/218

[58] Field of Search ..... 313/218, 217; 315/58

[56] References Cited

U.S. PATENT DOCUMENTS

| | | | |
|---|---|---|---|
| 3,134,924 | 5/1964 | Henderson et al. | 313/218 X |
| 3,334,269 | 8/1967 | L'Heureux | 313/220 X |
| 3,742,282 | 6/1973 | Siegle | 313/218 X |
| 3,798,483 | 3/1974 | Walters | 315/58 X |
| 3,959,683 | 5/1976 | Kupsky | 313/218 |
| 4,002,945 | 1/1977 | Van Houten et al. | 315/58 |
| 4,053,804 | 10/1977 | Aboelfotoh | 313/218 |

*Primary Examiner*—Palmer C. Demeo

*Attorney, Agent, or Firm*—Sughrue, Mion, Zinn, Macpeak and Seas

[57] ABSTRACT

The cathodes in a D.C. gas discharge panel are isolated from the gas by a layer of refractory material doped with a noble metal. The doping is sufficient to prevent the build-up of a surface wall charge on the layer during D.C. operation of the panel.

14 Claims, 4 Drawing Figures

D.C. SCAN PANEL

BACKGROUND OF THE INVENTION

The present invention relates to gas discharge display panels and, more particularly, to such display panels which operate in a D.C. mode.

Gas discharge panels in which two orthogonal sets of conductors sandwiched an ionizable gas are well known in the art. In such devices, a potential applied to one of the anodes and one of the cathodes will result in the excitation of the gas at the intersection of those electrodes, and the resulting gas discharge will emit a visible light.

In A.C. gas discharge panels, the electrodes are isolated from the gas by a dielectric. During each half cycle of the A.C. excitation signal, a surface wall charge will build up on the surface of the dielectric in contact with the gas, and this wall charge will oppose the drive signal. This is advantageous in an A.C. display panel since the surface wall charge will rapidly extinguish the gas discharge and assist in breaking down the gas during the next half cycle of the A.C. signal. Since each breakdown during each half cycle of operation produces light emission from the selected cell or cells, a flicker-free display can be achieved by operating the display at a relatively high frequency, e.g., 30–40 kilocycles. A disadvantage of A.C. display panels is that the A.C. drive signal generation systems are quite expensive and the light output is sometimes unsatisfactory.

An alternative to the A.C. gas discharge panel is a D.C. panel which, like the A.C. panel, consists of two sets of orthogonally arranged conductors sandwiching an ionizable gas. In conventional D.C. operated gas discharge panels, the metal electrodes are in direct contact with the discharge. Therefore, the cathodes are constantly being bombarded by gas ions during D.C. operation. These gas ions may have sufficient energy to sputter atoms from the cathode surface. Many of the sputtered atoms will be deflected back to the cathode surface by collisions with the gas ions, but some will escape collisions with the gas ions and be deposited on some other surface within the device. This sputtering phenomenon will result in a decrease in the usable life of the device and it will also make cell switching more difficult.

Certain proposals have been made for protecting the cathodes in a D.C. panel from sputtering, but none have proven satisfactory. If a protective layer overlying the electrodes is employed, such a layer cannot be conductive without shorting out adjacent cathodes. It also cannot be a dielectric protective layer, since a dielectric will isolate the gas discharge cell from the D.C. excitation voltage. In contrast to the A.C. panel, in which a surface will charge build-up is desirable in order to aid in extinguishing the discharge and cause break-down during the next half cycle, a surface wall charge build-up in a D.C. operated panel will decrease the effective potential applied to the gas until the net voltage falls below the minimum required to sustain a gas discharge, at which time the cell will turn "off."

A somewhat similar problem has been recognized in A.C. discharge panels. In A.C. panels, the dielectric layer overlying the electrodes and isolating them from the discharge gas can become degraded due to ion bombardment from the discharge and, therefore, refractory oxide coverings for the dielectric layer have been proposed. However, the secondary emission characteristics of a refractory oxide such as magnesium oxide will increase under operating conditions, resulting in lowering the panel operation margin ($V_s$ max. − $V_s$ min.) by decreasing $V_s$ max. (where $V_s$ is the potential required to sustain gas discharge). In U.S. Pat. No. 4,053,804, assigned to the same assignee as the present application, this inventor has disclosed a technique for solving this problem in A.C. discharge panels. The technique comprises depositing over the dielectric layer in the A.C. panel a protective covering of MgO, which may be approximately 2,000 Å thick, and then depositing over the MgO layer a further layer of MgO doped to a level of 5% gold. The gold-doped layer is relatively thin, on the order of 200 Å. The gold doping will sufficiently reduce the secondary emission characteristics of the MgO to provide a relatively constant operating margin by substantially reducing the decrease in $V_s$ max.

In an A.C. discharge panel, as described above, it is important to have a charge build up on opposite surfaces of the discharge cell, the charge build-up having a polarity which is opposite the polarity of the A.C. excitation signal, to aid in promptly extinguishing the discharge and in causing gas breakdown during the following half cycle of operation. If the MgO protective layer is doped with a substantial amount of gold, the surface charge will be permitted to migrate into the MgO layer and the cell will not operate satisfactorily. Thus, the upper surface layer of the MgO protective layer is doped with a small amount of gold, e.g., 200 Å. This will substantially lower the secondary emission characteristics but will not permit the surface wall charge build-up to dissipate.

Such a sputtering protection technique would not be acceptable in correcting cathode sputtering in a D.C. discharge panel, since any surface charge build-up is undesirable in D.C. operation.

SUMMARY OF THE INVENTION

Accordingly, it is an object of the present invention to provide a D.C. gas discharge display panel in which the cathodes are substantially protected from sputtering.

Briefly, the cathodes in a D.C. gas discharge display panel are protected from sputtering by a layer of a refractory oxide which is doped with a noble metal to such an extent that surface wall charge build-up will be prevented. In this way, the conductors will be protected from ion bombardment and will remain sufficiently isolated from one another, yet the protective layer will not result in any surface charge build-up. Further, the resistance of the protective layer will tend to concentrate the discharge in the immediate vicinity of the electrode intersections, thus eliminating the necessity of barriers between adjacent discharge cells which are commonly provided in known D.C. gas discharge panels.

A BRIEF DESCRIPTION OF THE DRAWINGS

DETAILED DESCRIPTION OF THE INVENTION

Figure 1:
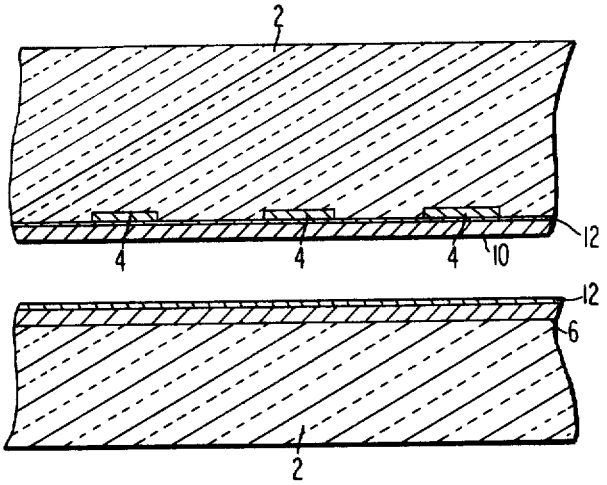
FIG. 1 is a side sectional view of a portion of a D.C. display panel according to the present invention.

In the D.C. discharge panel, according to the present invention, cathode and anode electrodes 4 and 6, respectively, are deposited on glass substrates 2 as shown in FIG. 1. The cathode electrodes are then isolated from the discharge by a layer 10 consisting of a mixture of a refractory material such as magnesium oxide (MgO) and a noble metal such as gold or silver. The purpose of incorporating the noble metal into the isolating layer is to increase the conductivity of the layer to such an extent that surface wall charge cannot develop during the D.C. operation of the discharge cell. The cathodes 4 are thus protected from ion bombardment by a protective layer which is capable of neither shorting out adjacent cathode electrodes or building up a surface wall charge during D.C. operation. Further, the secondary emissivity of the layer 10 will permit higher discharge currents to float through the cell with lower applied voltages, thus reducing the power requirements of the discharge panel.

In fabricating the device shown in FIG. 1, the electrodes 4 and 6 are first deposited on the glass substrates 2. Suitable electrodes would be 1,000–10,000 Å of aluminum or gold, or chrome-copper-chrome (1,000 Å Cr.-5,000–10,000 Å Cu-1,500 Å Cr.). The electrodes are two sets of parallel lines mounted orthogonally as shown in FIG. 1, one set constituting all of the anodes 6 and the other set constituting all of the cathodes 4. At the beginning of evaporation, a MgO layer of about 200 Å or less is first deposited on the cathodes before the shutter on the gold source is opened. The purpose of depositing the small MgO layer before opening the gold shutter is opened is only to assure that no pure gold is deposited onto the electrodes to cause a shorting of the electrodes. The gold source is then opened and a 2,000–3,000 A layer of MgO doped with a noble metal such as gold or silver is then deposited over the cathodes. The doping of the magnesium oxide is carried out by co-evaporation of magnesium oxide and the doping metal, for example, gold, using two separate sources. The percentage of gold in the magnesium oxide is controlled by controlling the evaporation rate of the gold so that the doped oxide layer is approximately 80% by volume MgO and 20% by volume Au. It has been discovered that the conductivity of such a layer will be high enough that no surface wall charge can develop during D.C. operation.

In D.C. operation, the anodes are not subjected to ion bombardment by discharge gas ions and, therefore, it is unnecessary to isolate them from the discharge. However, in conventional D.C. discharge panels, the gas discharge tends to spread in a direction parallel to the cathodes and, therefore, it has heretofore been necessary to provide between adjacent discharge cells an isolating ridge or aperture plate to confine each gas discharge to its corresponding electrode intersection. During experiments, it was discovered that this discharge spreading could be eliminated by depositing a layer 12 of approximately 200 Å of magnesium oxide over the anodes. Thus, after depositing the electrodes onto the substrates, a 200 Å layer of magnesium oxide could be simultaneously deposited over the anodes and cathodes, followed by deposition of the gold-doped magnesium oxide layer over the cathodes.

Figure 2:
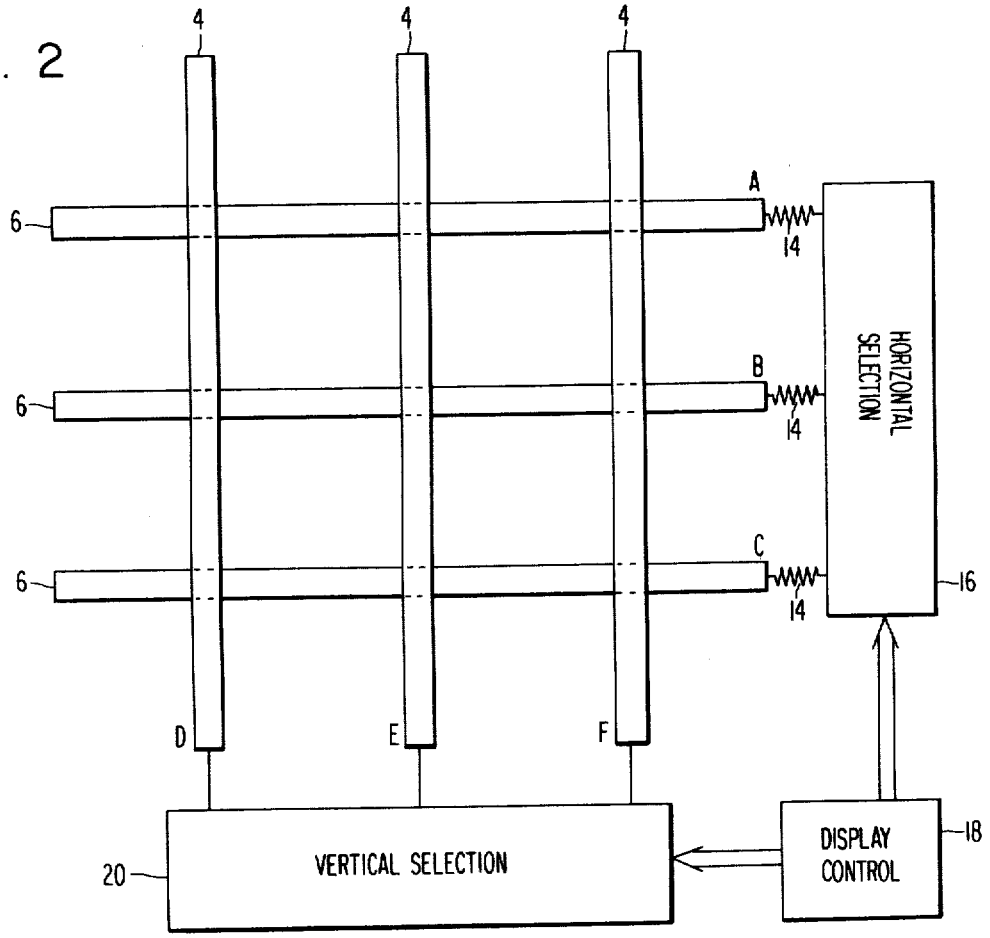
FIG. 2 is a diagram illustrating the basic operation of the discharge cell according to the present invention.

FIG. 2 illustrates the basic technique for activating the gas discharge panel. In a discharge cell of the type illustrated in FIG. 1, a firing voltage $V_f$ is required in order to initiate the gas discharge. After initiation of the discharge, the applied potential can be decreased without extinguishing the discharge. At some point, the potential reaches an extinguishing voltage at which the illumination resulting from the gas discharge ceases. Voltage thresholds typical of a gas discharge cell having 4 mil conductors on 20 mil centers and a 4 mil discharge gap such as that illustrated in FIG. 1 are a firing voltage of approximately 145 volts, extinguishing voltage of approximately 125 volts, with a voltage level of approximately 130–135 volts being sufficient to sustain gas discharge.

In operating the display, the anodes 6 can be maintained at a constant 120 volts bias potential. When it is desired to provide illumination at the intersection of, for example, anode B and cathode E, an additional 25 volts is supplied to the anode B, while the potential applied to cathode E is maintained at ground. The remaining cathodes D and F can either be left floating or a 25 volt signal can be applied in order to offset the additional 25 volts supplied to the anode. In this way, only the B-E intersection will be subjected to the firing potential of 145 volts. The resistors 14 are provided in order to limit the current which flows through the cell during discharge. The application of the additional 25 volts to the appropriate anodes can be accomplished through a horizontal selection circuit 16 in response to information from a display control 18. Likewise, the application of either ground potential or a 25 volt "deselection" potential to the appropriate cathodes can be controlled by the vertical selection circuit 20 in response to information provided by a display control.

To operate the discharge panel in a "memory" mode in which the display is obtained and remains until it is positively erased, the circuitry should be designed such that, with no switching signal applied to either the anode or cathode electrodes, the voltage applied to each discharge cell would exceed the sustain voltage of the cell. Further, the magnitude of the switching signal applied to either the cathode or anode should not by itself be sufficient to implement either write or erase operations. For a firing voltage $V_f$ of 145 volts, and an extinguishing voltage of 125 volts, the bias potential continuously applied to the anodes 6 through the horizontal selection circuit could be 135 volts with the selection circuit 16 being capable of imposing an additional plus or minus 5 volt signal on the 135 volt bias. The vertical selection circuit 20 could apply ground potential to the cathodes 4 and also be capable of selectively applying $\pm 5$ volts to the cathodes. In order to initiate gas discharge at the intersection of, for example, anode A and cathode D, the horizontal selection circuit would apply an additional 5 volt signal to anode A while maintaining anodes B and C at the 135 volt bias level. Vertical selection circuit 20 would then apply a 5 volt potential to cathode D while maintaining cathodes E and F at ground potential. Intersections A-E and A-F would be subject to a total potential difference of 140 volts, a potential which is insufficient to initiate gas discharge. Intersection A-D would be subject to a 145 volt potential and gas discharge would occur. Energization of selected intersections on the B anode would be implemented in the same fashion. Note that during energization of selected intersections on the B anode, the A anode is maintained at a 135 volt potential. Since all of the cathodes are maintained at either 0 or 5 volt levels, the potential difference at each of the intersections along the A anode will either be 130 or 135 volts, sufficient to sustain the discharges along anode A.

In order to erase selected intersections, the horizontal selection circuit 16 applies to a selected anode A-5 volt erase signal and the vertical selection circuit 20 applies to a selected cathode, a +5 volt erase signal. The potential at the intersection of the selected anode and cathode will be only 125 volts, thus extinguishing the gas discharge. At all non-selected intersections, the potential difference will be 130 volts and the gas discharge will be sustained.

The above description of the "memory" mode of operation of the gas discharge panel according to the present invention is given by way of example only. The firing, sustain and extinguishing voltages of the gas discharge cells should be determined empirically and the bias and switching potentials applied from the horizontal and vertical selection circuits should be selected according to the empirically determined characteristics of the cells. For example, it may be that the gas discharge cells have an extinguishing voltage of 130 volts rather than 125 volts and the bias and switching potentials would then have to be altered accordingly.

Further, the details of the display control, horizontal selection circuitry and vertical selection circuitry do not constitute a part of the present invention and need not be described herein. The circuitry necessary to operate the D.C. gas discharge panel according to the present invention would be obvious to one of ordinary skill in the art.

Figure 3:
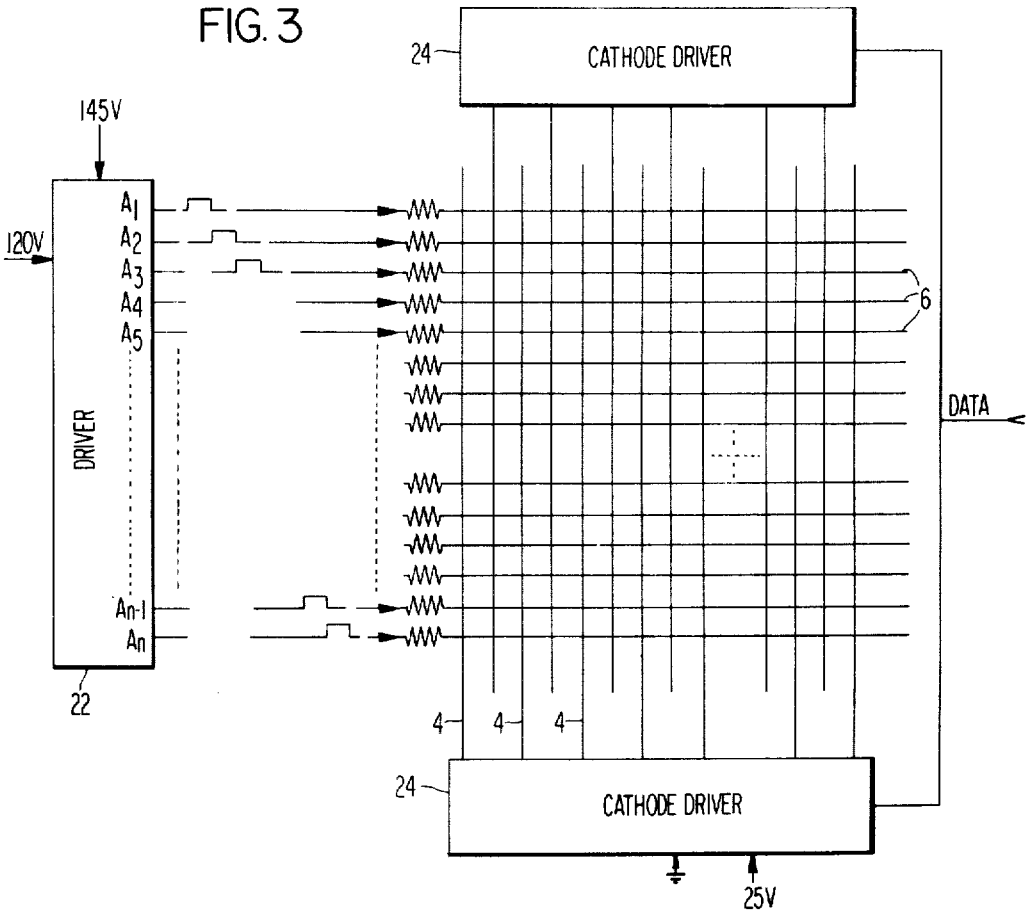
FIG. 3 is a diagram illustrating a refresh mode of operation for the D.C. discharge panel according to the present invention.

The D.C. gas discharge panel could also be operated in a "scan" or "refresh" mode as will be described with reference to FIG. 3. In the refresh mode of operation, the intersections are periodically pulsed or "refreshed" in order to maintain a display. Thus, it is unnecessary to maintain a bias potential which is above the sustaining voltage, and it is also unnecessary to provide erase signals, since any non-selected intersection will automatically erased by a failure to refresh that cell. The bias potential applied to the anodes $A_1$–$A_n$ by the anode driver 22 can be 120 volts, slightly below the extinguishing voltage of each cell. The driver is designed to provide at successive outputs a pulse of an additional 25 volts, making the total applied potential 145 volts. The pulses can be, for example, approximately 250 microseconds in duration. The cathode drivers 24 will determine which of the electrode intersections is to be energized. If the anode and cathode drivers are clocked synchronously, the application of a pulse to anode $A_1$ from anode driver 22 will coincide with the application of ground potential to selected cathodes and a 25 volt potential to non-selected cathodes from the cathode drivers 24. The immediately following pulse to anode $A_2$ will coincide with an appropriate change in the potentials applied to the cathodes from cathode drivers 24 so that different selected intersections along anode $A_2$ will be illuminated. Once all of the anodes have been pulsed, the cycle is repeated. The display can be continuously changed by changing the data supplied to the cathode drivers 24. The frequency of the pulses to each anode should be empirically determined from the cell characteristics so that the interval between pulses applied to any one anode is less than the time required for the gas discharge to decay. In this way, a substantially flicker-free display can be maintained.

As in the above-described memory mode of operation, the circuitry details required to operate the D.C. gas discharge panel according to the present invention in the refresh mode would be obvious to one of ordinary skill in the art and do not constitute a part of the present invention.

Figure 4:
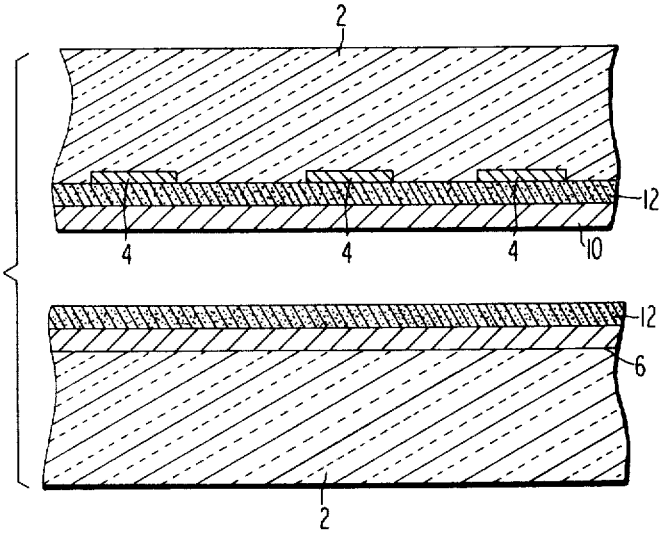
FIG. 4 is a side sectional view of a modification of the discharge panel shown in FIG 1.

FIG. 4 shows an alternative embodiment of the D.C. gas discharge panel according to the present invention. In FIGS. 2 and 3, resistors 14 are provided in series with each anode in order to limit the current flowing through each cell during the gas discharge. These resistances are built in to the discharge panel of FIG. 4. In FIG. 4, a relatively thick MgO layer can be grown on the anode and/or cathode electrodes prior to deposition of the gold-doped MgO layer. The layer 12 is deposited at a sufficiently high rate, e.g., 20–30 Å/sec. so that substantial amounts of oxygen will be lost and non-stoichiometric MgO will be obtained. This will result in a resistance layer rather than an insulation layer. The thickness of the layer 12 should be approximately 100–10,000 Å, depending upon the resistance value desired to limit the cell current. A suitable level of cell current may be approximately 30 μA/cell. After deposition of the MgO resistor layer 12 on the anode and/or cathode, the gold-doped MgO layer 10 is then deposited over the cathodes in the same manner as in FIG. 1.

In manufacturing the discharge panel according to the present invention, electrodes 4 and 6 are deposited on glass substrates 2, a non-stoichiometric MgO layer is then deposited on the anodes and/or cathodes to a thickness 100–10,000 Å, depending upon the value of resistance desired, and finally, the gold-doped MgO layer 10 is deposited over the cathodes. The layer 10 should be approximately 10–25 percent by volume Au (or Ag) with the remainder MgO, and should have a thickness of 2,000–3,000 Å. Such a doping will result in a protective layer which exhibits enough conductivity to prevent the build up of a wall charge in the cell, yet exhibits enough resistance to isolate adjacent electrodes from one another. Not only is sputtering of the cathodes prevented by the protective layer, but the secondary electron emission coefficient of the protective layer results in a lower D.C. voltage being required in order to maintain the discharge. Further, the resistance of the layer 12 tends to concentrate the discharge in the immediate vicinity of each electrode intersection, thus eliminating the need for structure for separating adjacent cells, e.g., aperture plates or grooved panel structures. In the following claims, this lack of structure for separating adjacent cells is referred to as an "open internal" structure.

What is claimed is:

1. In a d.c. gaseous discharge display device, an ionizable gaseous medium in a gas chamber formed by a pair of glass plates, a plurality of cathode conductors orthogonal to said anode conductors and disposed on a surface of the other of said glass plates, a quantity of material overlying said cathode conductors to protect said cathode conductors from sputtering during gaseous discharge, said material comprising a doped mixture of a refractory oxide insulator and a metal dopant, said doped refractory oxide material having sufficient conductivity to prevent the build-up of a surface wall charge during d.c. operation of said display device and having sufficient secondary emissivity to reduce the voltage required to sustain gaseous discharge.

2. A d.c. gaseous display device according to claim 1, wherein said quantity of material comprises a first layer approximately 200 Å or less in thickness of said refractory oxide insulator and a second layer comprising said mixture 3. A d.c. gaseous discharge display device according to claim 1, wherein each intersection of a cathode conductor and an anode conductor defines a gas discharge cell, said display device having an open internal structure, i.e. having no structure physically separating adjacent cells.

4. A d.c. gaseous discharge display device according to claim 3, said display device further comprising a layer of resistive refractory material overlying said anode conductors for preventing the spread of gas discharge between adjacent cells.

5. A d.c. gaseous discharge display device according to claim 4, wherein said layer of resistive refractory material overlying said anode conductors provides a resistance in series with each cell in order to limit the current through each cell during gas discharge.

6. A d.c. gaseous discharge display device according to claim 5, wherein said quantity of material comprises a first layer consisting of a resistive refractory material and a second layer comprising said mixture and wherein said first layer and said layer of resistive refractory material overlying said anode conductors are each approximately 100–10,000 Å in thickness.

7. A d.c. gaseous discharge display device according to any one of claims 2, 4, 5 or 6, wherein said dopant metal is a noble metal.

8. A d.c. gaseous discharge display device according to claim 7, wherein said doped mixture is approximately 2,000–3,000 Å in thickness.

9. A d.c. gaseous discharge display device according to claim 7, wherein said noble metal comprises approximately 10–25% by volume of said mixture.

10. A d.c. gaseous discharge display device according to claim 9, wherein said noble metal is gold.

11. A d.c. gaseous discharge display device according to claim 9, wherein said noble metal is silver.

12. A d.c. gaseous discharge display device according to claim 2, wherein said first layer comprises MgO.

13. A d.c. gaseous discharge display device according to claim 12, wherein said second layer is MgO, doped with 10–25% by volume gold.

14. A d.c. gaseous discharge display device according to any one of claims 4–6, wherein said resistive refractory material overlying said anode conductors is a non-stoichiometric refractory oxide.

* * * * *